United States Patent [19]

Widmayer

[11] Patent Number: 4,642,525

[45] Date of Patent: Feb. 10, 1987

[54] TRANSIENT CONTROL CIRCUIT FOR FLUORESCENT LAMP SYSTEMS

[76] Inventor: Don F. Widmayer, 4704 Locust Hill Rd., Bethesda, Md. 20814

[21] Appl. No.: 723,184

[22] Filed: Apr. 15, 1985

[51] Int. Cl.[4] ..... H05B 37/02; H05B 39/04; H05B 41/36

[52] U.S. Cl. ..... 315/219; 315/102; 315/224; 315/209 R; 315/291; 315/DIG. 7

[58] Field of Search ..... 315/209 R, 102, 219, 315/224, 209, 291, DIG. 2, DIG. 7

[56] References Cited

U.S. PATENT DOCUMENTS

| | | | |
|---|---|---|---|
| 4,215,292 | 7/1980 | Inui et al. | 315/102 X |
| 4,253,043 | 2/1981 | Chermin et al. | 315/102 X |
| 4,277,726 | 7/1981 | Burke | 315/DIG. 7 X |
| 4,352,045 | 9/1982 | Widmayer | 315/291 |

*Primary Examiner*—Saxfield Chatmon

*Attorney, Agent, or Firm*—Larson and Taylor

[57] ABSTRACT

A method and apparatus are provided for operating a fluorescent lamp illumination control sytem which comprises an AC voltage source for supplying power to an electrical load comprising a standard transformer-ballast unit driving a fluorescent lamp or lamps which have externally heated cathodes, and a power controller, which includes a capacitive synchronous switch formed by an electronic switch and shunt capacitor, for controlling the "on" time of the lamp or lamps to thereby vary the luminance output thereof to values less than the nominal rated value. The invention provides heating of the lamp cathodes prior to arc ignition, provides arc ignition at a lower arc current level than that for full-on operation, and provides for subsequently gradually increasing the arc current after the arc is struck to a value providing the desired illumination level.

4 Claims, 3 Drawing Figures

TRANSIENT CONTROL CIRCUIT FOR FLUORESCENT LAMP SYSTEMS

FIELD OF THE INVENTION

The present invention relates to control systems for fluorescent lamps and, more particularly, to an improved starting method and system for such lamps which reduces the effect of transients and extends the life of the lamp cathodes.

BACKGROUND OF THE INVENTION

It is generally recognized by those skilled in the art of electrical dimming control systems for fluorescent lamps that the externally heated cathodes of rapid start type fluorescent lamps must be heated to a temperature that permits the required level of thermionic electron emission to be achieved. For this reason, such fluorescent lamp dimming control systems usually provide for initially turning the lamps "full-on" so that the rated arc current flows, before dimming, i.e., reduction of the arc current, is undertaken. Such full-on ignition of the lamps is generally accomplished by applying full rated line voltage to the standard transformer-ballast usually employed as the lamp driver. This approach is described, for example, in U.S. Pat. No. 4,350,935 (see column 12 lines 27–35) and U.S. Pat. No. 4,352,045 (see column 7 starting at line 5). When full rated A.C. line voltage is applied to the ballast driving the fluorescent lamp load, the cathode heating voltage as well as the necessary arc striking voltage appear at the lamp electrodes at the specified nominal magnitudes. After a short heating period, the cathode begins to emit electrons, and the arc thereafter ignites and extinguishes one or more times before the cathode reaches the temperature at which the thermionic emission provided is capable of sustaining the arc at the rated current. This initial arc-on/arc-off operation causes the cathode to "sputter" which substantially contributes to cathode wear. The term "sputtering" as used here refers to the actual physical emission or giving off of cathode material from the remainder of the cathode caused when arc current flows to the cathode prior to the temperature of the cathode reaching a value which insures sufficient electron emission. Thus the cathode is, in effect, operating in a temperature-limited mode rather than in a space-charge-limited mode as intended.

Cathode wear is the primary determinant of the life of a fluorescent lamp because when the cathode is finally consumed, insufficient emission electrons are available to ignite or maintain the arc. Nevertheless, this ignition wear phenomena is accepted in the prior art. The lamp manufacturing industry generally rates a standard 40 watt lamp as having a 20,000 hour Mean Time Between Failure (MTBF) life based on a test cycle of three hours "on" and twenty minutes "off". If it also well known that lamp operating life will be extended when longer "on" periods are provided between the starting events which cause the cathode wear.

SUMMARY OF THE INVENTION

This invention concerns a novel apparatus for providing efficient, long-life operation of the class of fluorescent lamp control systems based on the power control techniques disclosed in my U.S. Pat. No. 4,352,045, issued on Sept. 28, 1982, and my copending application Ser. No. 571,830, filed on Jan. 19, 1984, the subject matter of which is hereby incorporated by reference. In particular, the invention is applicable to systems which comprise an A.C. voltage source for supplying power to an electrical load device comprising a transformer-ballast driving a fluorescent lamp or lamps having externally heated cathodes, and which use the power control methodology disclosed in the above-identified patent and patent application. Although reference is made to the patent and patent application for a more complete description of this methodology, a key element thereof concerns the control of a capacitive synchronous switch, i.e., a synchronously operated switch such as a transistor having a capacitor connected in shunt thereacross.

An object of the invention is to reduce the cathode wear discussed above and thus extend lamp life, as well as reduce any deterministic or probabilistic excursions of electric circuit variables which exceed the normal steady state values of system components due to changes in the operating state of the system, e.g., excursions (transients) produced by switching of the branch circuit used to implement the A.C. voltage source. The advantages provided by the invention include a longer operating life for the lamps or lamps used and/or for other system components, a more efficient system operation, and an ability to employ relatively low cost semiconductor devices in the implementation of the power controller. In addition, there are energy savings provided by the "dimming-up" operation provided by the system of the invention wherein the illumination produced is gradually brought up to the desired level, as contrasted with prior art systems which provide full-on initial operation and then provide dimming down to the desired level. It is noted that this latter mode of dimming for visual purposes even has negative psychological effects, which are eliminated with the system of the invention.

In accordance with a preferred embodiment of the invention, a system is provided for controlling the A.C. power supplied from an A.C. source to an electrical load comprising at least one transformer ballast and at least one fluorescent lamp driven by the transformer ballast and including externally heated cathodes, the system including a switch connected between the A.C. source and the load, a power controller for controlling switching of the switch in timed relation to the A.C. source voltage wave so as to control the power supplied to the load, a capacitor connected in shunt across the switch, and control means, connected to the power controller system, for, responsive to energization of the system, controlling the switching operation of the switch provided by said power controller so as to initially limit the arc current supplied to the load and thereby provide for ignition of the arc of the at least one fluorescent lamp at an arc current level less than that provided during full on operating conditions while also providing heating of the externally heated cathodes prior to the ignition of the arc, and so as to thereafter provide gradually increasing arc current up to a predetermined value which produces the desired illumination level.

In an exemplary embodiment, the power controller comprises a control circuit producing a square wave output for controlling switching of the switch and the control means initially inhibits the square wave output of the control circuit and thereafter controls the duration of the square wave pulses produced by the control circuit so as to provide a gradual increase in the duration of these pulses with time. Advantageously, the control circuit includes an operational amplifier and the control means comprises means for supplying a gradually increasing voltage to one input of the operational amplifier. In a specific preferred embodiment, the voltage supplying means comprises a resistor-capacitor circuit and the gradually increasing voltage is produced by charging of the capacitor of the resistor-capacitor circuit.

Other features and advantages of the present invention will be set forth, or apparent from, the detailed description of the preferred embodiments which follows.

DESCRIPTION OF THE PREFERRED EMBODIMENTS

Figure 1:
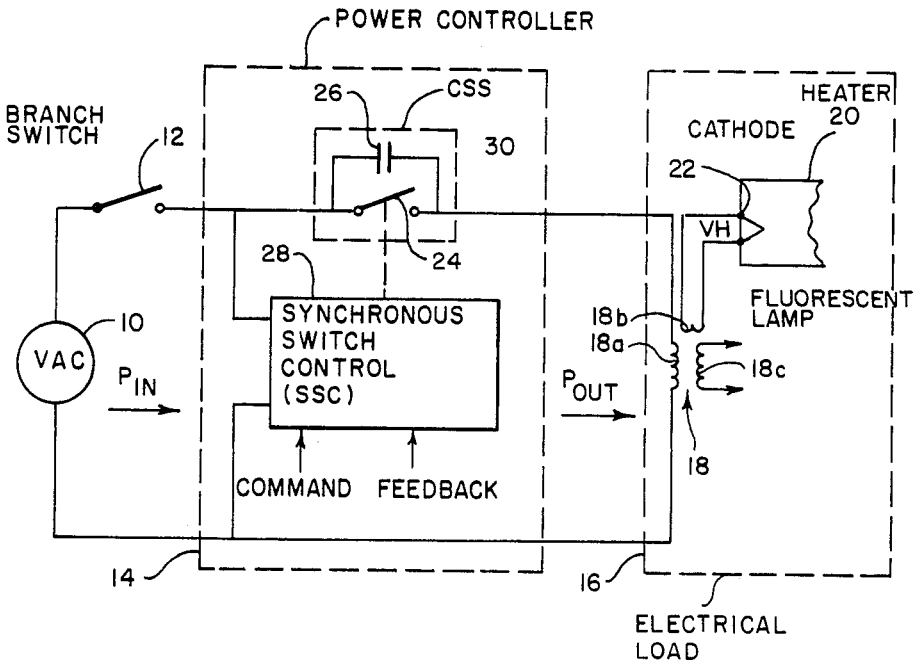
FIG. 1 is block diagram of the basic system in whch the present invention is incorporated.

Referring to FIG. 1, which is a schematic block diagram similar to that in my copending U.S. Ser. No. 571,830, filed on Jan. 19, 1984, there is shown the basic units or components of a system of the general type to which the invention is applicable. The system of FIG. 1 includes a power source which is implemented by a branch circuit A.C. voltage source 10 and a branch circuit switching device 12, a two-port (input and output) power controller 14 and an electrical load 16. The controller 14 requires three wires, with the common wire being either the "hot" wire or the neutral wire of the branch circuit.

As indicated in FIG. 1, the electrical load comprises a transformer ballast 18 and a fluorescent lamp 20 having a cathode heater indicated at 22. The primary winding 18*a* of the transformer ballast 18 is coupled to a low voltage winding 18*a* which provides the current necessary to externally heat the electrodes of lamp 20. It will be appreciated that these electrodes operate alternately as cathodes and anodes at the line frequency of the A.C. voltage source 10 (usually 60 Hz in the United States), and that the heater pins of these electrodes are represented schematically by cathode heater 22. It will also be understood that the showing in FIG. 1 is highly schematic and that the transformer ballast secondary winding 18*c* is connected in a conventional manner to the lamp load. Further, a plurality of transformer ballasts and lamps can be obviously employed.

As shown, power controller 14 comprises a switch 24 having a capacitor 26 connected in shunt thereacross and a synchronous switch control (SSC) circuit 28 for controlling switching of switch 24. For shorthand purposes switch 24 and capacitor 26 will be referred to collectively as a capacitive synchronous switch (CSS) which is denoted 30.

An important purpose of the invention is to supply at least a minimum heater voltage, denoted $V_h$, to the cathode heater pins 22 of lamp 20 which is sufficient to provide external heating thereof to a design temperature which provides for the level of thermionic emission required for long lamp life as discussed above. To this end, the CSS 30 is operated under the control of SSC 28 to maintain the RMS (heating) value of the heater voltage $V_h$ above the minimum required to provide long lamp life throughout all operating states of CSS 30 from full "off" (i.e., the switch open condition) where capacitor 26 is connected in series with the primary winding 18*a* of transformer ballast 18 to full "on" (the switch closed condition) wherein the full line voltage $V_{AC}$ is applied to primary winding 18*a*. It is noted that for the full "off" state referred to above, the RMS voltage applied to the transformer-ballast primary winding 18*a* would be near the rated vaue and this requires selecting an appropriate value for capacitor 26 of CSS 30. Typically, a capacitive value of 3 microfarads is useful with a standard 120 volt, 0.8 ampere high power factor transformer-ballast driving two standard F40 type, 40 watt rapid start fluorescent lamps. The value of capacitor 26 can be determined empirically by adding series capacitance to the ballast primary 18*a* until the RMS voltage across the primary winding 18*a* approaches that of the A.C. line or the voltage at the cathode heater 22 approaches a nominal 4.0 volts without firing of the lamp arc, this value dropping towards 3.0 volts with lamp loading.

A characteristic of the power control methodology disclosed in my previous applications is that switching from the full "off" state to full "on" state within a half cycle of the line voltage produces a large transient line current. This is the consequence of the inability of the ferromagnetic core of the transformer ballast 18 to readily accommodate the sudden polarity or phase reversal produced by this off-on switching. Further, if, in addition, there is asynchronous operation, such as is the case during initial turn-on, there will be additional stressing or burdening of the semiconductor device or devices represented by switch 24. These effects cannot be avoided and thus the consequences thereof must be limited or eliminated.

A further property or characteristic of the power control method with which the invention is concerned is that a step change in the state of the CSS 30 requires a finite number of power line cycles before the resultant line current transient caused by this change subsides to zero and before the line current reaches the new steady state value thereof. The minimum time constant of the lag represented by this finite number of cycles is dependent upon the parasitic resistance and inductance of the ballast transformer 18 when the core material is at or near the saturated flux state thereof. The mechanism providing the decay of the transients is the asymmetries in the positive and negative instantaneous line current waveforms during a half cycle of the operation of CSS 30 acting with the aforementioned parasitics to bring the circuit operating state to the new symmetrical A.C. ($V_{dc}=0$) steady state value.

Figure 2:
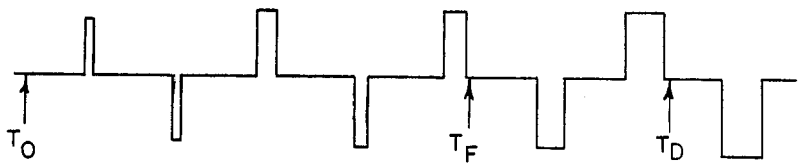
FIG. 2 is schematic representation of the waveforms associated of the operation of the invention.

The present invention is concerned with providing a continuous, gradual change in the switching time between the full off and on states of the CSS 30 in a manner such that the transient line currents produced by the polarity (or phase) reversals from half cycle to half cycle are limited to a predetermined value below that which could be harmful to the semiconductor device(s) used to implement switch 26 of CSS 30. The invention provides for gradually increasing the "on" time of the switch 24 until a level is reached where the lamps fire, while providing a prefiring voltage which is always sufficient to provide full heating of the lamp cathodes, thereby ameliorating the effects of the current transients and asynchronous operation, while providing the required cathode heating. This approach preserves the fundamental operating characteristics of the power control techniques of my earlier application and patent while providing lamp cathode heating at or above the required minimum for all operating states, i.e., for both transient (upon starting) and steady state operation. This mode of operation provided by the invention is indicated in a highly schematic manner in FIG. 2 in which the output with time of the SSC circuit 28 used in controlling switch 24 is shown as increasing gradually from a zero value at an initial time ($T_O$) to a value at which the lamps fire ($T_F$) and thereafter to a desired operating value ($T_D$). It should be noted that FIG. 2 is highly schematic and a large number of cycles would normally occur before the arc is struck.

Figure 3:
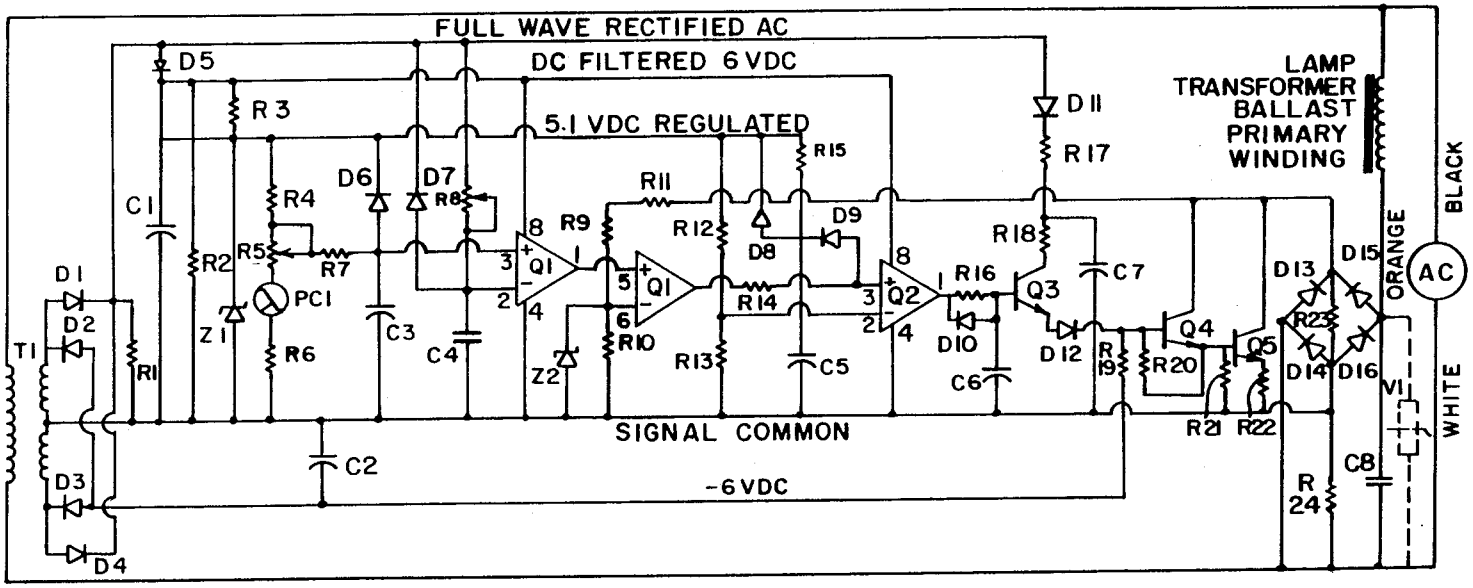
FIG. 3 is a schematic circuit diagram of a lighting control system incorporating the invention.

Referring to FIG. 3, a schematic circuit diagram of a light control system incorporating the invention is illustrated. The circuit shown is basically very similar to that disclosed in my U.S. Pat. No. 4,352,045 and my copending application 571,830, and the following description thereof will be largely limited to the portions of the circuit used in implementing the invention. The CSS 30 of FIG. 1 is basically constituted by transistors Q4 and Q5 and the diode bridge formed by diodes D13, D14, D15 and D16 (corresponding to switch 24 of FIG. 1), and capacitor C8 (corresponding to capacitor 26 of FIG. 1). It is also noted that detection of the voltage on the switch formed by transistor Q4 Q5 and the diodes, used in inhibiting closing of the switch by the control circuit as provided for in Ser. No. 571,830, is implemented in this embodiment by the connection to the diode bridge which includes resistors R11, R9 and R10 and a Zener diode Z2 connected in shunt with resistor R10.

In order to effect the aforementioned slow turn-on of the synchronous switch formed by transistors Q4 and Q5 and the full wave bridge diodes, a resistor-capacitor network, comprising a series resistor R7 and a shunt capacitor C3, is connected to the input of an operational amplifier Q1 of the power controller so as to inhibit the square wave output of the operational amplifier Q1 during the time after the initial energization of the system that is required for capacitor C3 to charge to the steady state level thereof. (It is noted that dual operational amplifiers Q1 are employed in this specific embodiment and reference will be made to the first operational amplifier of the dual in the discussion which follows). Initially, capacitor C3 will provide a short circuit, thereby holding the base of operational amplifier Q1 to zero volts, and as capacitor C3 charges, operational amplifier Q1 will begin produce a time limited square wave output, the duration of which gradually increases as discussed above. As explained previously, and is shown schematically in FIG. 2, after operational amplifier Q1 first produces a square wave output, the duration of the square wave will gradually increase with time until the voltage produced is such as to provide ignition of the arc and to establish equilibrium. This time period from initial energization to arc ignition is typically one or more seconds.

The invention has been described above relative to the application thereof to rapid start fluorescent lamps, but it is to be understood that the invention is also useful in connection with other fluorescent lamps such as so-called "preheat" lamps, and that the transient amelioration and upward dimming features of the invention have application to even instant start fluorescent lamps.

Although the invention has been described relative to exemplary embodiments thereof, it will be understood by those skilled in the art that variations and modifications can be effected in the exemplary embodiments without departing from the scope and spirit of the invention.

What is claimed is:

1. A system for controlling the A.C. power supplied from an A.C. source to an electrical load comprising at least one transformer ballast and at least one fluorescent lamp driven by said transformer ballast and incluing externally heated cathodes, said system including an electronic switch connected between the A.C. source and the load, a switching controller for controlling switching of said switch in timed relation to the A.C source voltage wave so as to control the power supplied to the load by applying to the switch control pulses the duration of which control the time during a cycle of the A.C. source voltage wave which the switch is turned on, and a capacitor connected in shunt across said switch, said switching controller including control means for, when the system is turned on, initially limiting the pulse duration of the control pulses applied to said switch and for thereafter gradually increasing the pulse duration of said control pulses over a plurality of cycles of the A.C. source voltage wave to thereby reduce the effect of the starting transient produced when the system is turned on and to gradually increase the lamp arc current from an initial minimum value to a value which produces the desired illumination level.

2. A system as claimed in claim 1 wherein said switching controller comprises a control circuit for producing square wave output control pulses for controlling switching of said switch and said control means initially inhibits the square wave output of said control circuit and thereafter controls the duration of the square wave control pulses produced by said control circuit so as to provide a gradual increase in the duration of said pulses with time.

3. A system as claimed in claim 2 wherein said control circuit includes an operational amplifier and said control means comprises means for supplying a gradually increasing voltage to one input of said operational amplifier.

4. A system as claimed in claim 3 wherein said voltage supplying means comprises a resistor-capacitor circuit and said gradually increasing voltage is produced by charging of the capacitor of the resistor-capacitor circuit.

* * * * *